US010752005B2

(12) United States Patent
Shimizu

(10) Patent No.: US 10,752,005 B2
(45) Date of Patent: Aug. 25, 2020

(54) PRINTER, CONTROL METHOD OF PRINTER, AND NON-TRANSITORY COMPUTER-READABLE MEDIUM STORING COMPUTER READABLE INSTRUCTIONS

(71) Applicant: BROTHER KOGYO KABUSHIKI KAISHA, Nagoya-shi, Aichi-ken (JP)

(72) Inventor: Seiji Shimizu, Ogaki (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/360,167

(22) Filed: Mar. 21, 2019

(65) Prior Publication Data

US 2019/0299626 A1 Oct. 3, 2019

(30) Foreign Application Priority Data

Mar. 30, 2018 (JP) ..... 2018-067579

(51) Int. Cl.

| | |
|---|---|
| ***B41J 2/175*** | (2006.01) |
| ***B41J 2/18*** | (2006.01) |
| ***B41J 2/19*** | (2006.01) |
| ***B41J 29/38*** | (2006.01) |
| ***B41J 2/185*** | (2006.01) |

(52) U.S. Cl.

CPC ..... *B41J 2/17509* (2013.01); *B41J 2/175* (2013.01); *B41J 2/17596* (2013.01); *B41J 2/18* (2013.01); *B41J 2/185* (2013.01); *B41J 2/19* (2013.01); *B41J 29/38* (2013.01)

(58) Field of Classification Search

CPC .... B41J 2/175; B41J 2/17509; B41J 2/17596; B41J 2/18; B41J 2/185; B41J 2/19; B41J 29/38

See application file for complete search history.

(56) References Cited

U.S. PATENT DOCUMENTS

| | | | | |
|---|---|---|---|---|
| 6,224,201 | B1 | 5/2001 | Shigemura | |
| 8,366,224 | B2 | 2/2013 | Yokota et al. | |
| 2008/0273063 | A1* | 11/2008 | Wouters | B41J 2/1707 347/85 |

(Continued)

FOREIGN PATENT DOCUMENTS

| | | |
|---|---|---|
| EP | 1004445 A1 | 5/2000 |
| EP | 1243425 B1 | 5/2007 |

(Continued)

OTHER PUBLICATIONS

Extended European Search Report issued in connection with corresponding European Patent Application No. 19163494.8, dated Aug. 30, 2019. (15 pages).

*Primary Examiner* — Anh T Vo

(74) *Attorney, Agent, or Firm* — K&L Gates LLP

(57) ABSTRACT

When printing is performed by ejecting an ink from heads of a printer, a CPU drives a pump and performs main tank-side circulation processing that circulates the ink in a main tank, a tank-side supply flow path, a first bypass flow path and a tank-side circulation flow path. Therefore, a printer can perform the main tank-side circulation processing without waiting for the end of the printing, and it is possible to quickly replenish the sub tank with the ink that decreases during the printing.

10 Claims, 7 Drawing Sheets

(56) References Cited

U.S. PATENT DOCUMENTS

| | | | | |
|---|---|---|---|---|
| 2009/0102879 | A1* | 4/2009 | Katada | B41J 2/175 347/17 |
| 2011/0115844 | A1 | 5/2011 | Ozawa | |
| 2017/0239956 | A1* | 8/2017 | Karita | B41J 2/175 |
| 2017/0320331 | A1 | 11/2017 | Alessi et al. | |

FOREIGN PATENT DOCUMENTS

| | | | |
|---|---|---|---|
| EP | 2301756 | A1 | 3/2011 |
| EP | 2572885 | B1 | 4/2014 |
| EP | 2977209 | A1 | 1/2016 |
| EP | 3339039 | A1 | 6/2018 |
| JP | H11-042795 | A | 2/1999 |
| WO | 2009/157139 | A1 | 12/2009 |

* cited by examiner

PRINTER, CONTROL METHOD OF PRINTER, AND NON-TRANSITORY COMPUTER-READABLE MEDIUM STORING COMPUTER READABLE INSTRUCTIONS

CROSS-REFERENCE TO RELATED APPLICATION

This application claims priority to Japanese Patent Application No. 2018-67579 filed Mar. 30, 2018. The contents of the foregoing application are hereby incorporated herein by reference.

BACKGROUND

The present disclosure relates to a printer, a control method of a printer, and a non-transitory computer-readable medium storing computer-readable instructions.

A printer is known that circulates ink in order to remove air bubbles or eliminate sedimentation of ink components in a head or in a flow path from an ink tank to the head. The printer is provided with an inter-tank supply path that supplies an ink in a main tank to a sub tank, and a deaerator provided in the inter-tank supply path. The ink in the main tank is deaerated by the deaerator and is supplied to the sub tank. The ink in the sub tank is supplied to a three-way valve via a flowmeter, a deaerator and a dissolved oxygen meter that are provided in an ink supply path. The ink supplied to the three-way valve is supplied to the head by an operation of the three-way valve when the ink is ejected. When an amount of dissolved oxygen in the ink measured by the dissolved oxygen meter is relatively large, the ink is returned to the sub tank through an ink circulation path by an operation of the three-way valve.

SUMMARY

However, in the printer, the inter-tank supply path is not provided with a bypass flow path that returns the ink to the main tank without feeding the ink to the sub tank. Therefore, at the time of printing in which the ink is supplied from the sub tank to the head, ink circulation cannot be performed in order to return the ink in the main tank to the main tank via the inter-tank supply path. Thus, the circulation of the ink in the main tank cannot be performed until the end of the printing.

Embodiments of the broad principles derived herein provide a printer, a control method of a printer, and a non-transitory computer-readable medium storing computer readable instructions that make it possible to circulate ink in a main tank even at a time of printing.

A printer according to a first aspect of the present disclosure includes: a head configured to eject an ink; a main tank configured to store the ink; a sub tank configured to store the ink supplied from the main tank; a tank-side supply flow path configured to supply the ink from the main tank to the sub tank; a tank-side circulation flow path configured to circulate the ink from the sub tank to the main tank; a first bypass flow path configured to connect the tank-side supply flow path and the tank-side circulation flow path; a head-side supply flow path configured to supply the ink from the sub tank to the head; a first pump provided in the tank-side supply flow path; a processor; and a memory storing computer-readable instructions. The computer-readable instructions, when executed by the processor, perform processes including: driving the first pump and performing printing-time circulation processing that circulates the ink in the main tank, the tank-side supply flow path, the first bypass flow path and the tank-side circulation flow path, when printing is performed by ejecting the ink from the head.

In this case, when the printing is performed, it is possible to perform the printing-time circulation processing that circulates the ink in the main tank, the tank-side supply flow path, the first bypass flow path and the tank-side circulation flow path. Therefore, the printer can perform the printing-time circulation processing without waiting for the end of the printing, and it is thus possible to quickly replenish the sub tank with the ink that decreases during the printing.

A control method of a printer according to a second aspect of the present disclosure is a control method of a printer. The printer includes: a head configured to eject an ink; a main tank configured to store the ink; a sub tank configured to store the ink supplied from the main tank; a tank-side supply flow path configured to supply the ink from the main tank to the sub tank; a tank-side circulation flow path configured to circulate the ink from the sub tank to the main tank; a first bypass flow path configured to connect the tank-side supply flow path and the tank-side circulation flow path; a head-side supply flow path configured to supply the ink from the sub tank to the head; a first pump provided in the tank-side supply flow path; and a processor. The control method of the printer is characterized by driving the first pump and performing printing-time circulation processing that circulates the ink in the main tank, the tank-side supply flow path, the first bypass flow path and the tank-side circulation flow path, when printing is performed by ejecting the ink from the head.

In this case, when the printing is performed, it is possible to perform the printing-time circulation processing that circulates the ink in the main tank, the tank-side supply flow path, the first bypass flow path and the tank-side circulation flow path.

A non-transitory computer-readable medium storing computer-readable instructions according to a third aspect of the present disclosure is characterized by causing a processor of a printer that includes: a head configured to eject an ink; a main tank configured to store the ink; a sub tank configured to store the ink supplied from the main tank; a tank-side supply flow path configured to supply the ink from the main tank to the sub tank; a tank-side circulation flow path configured to circulate the ink from the sub tank to the main tank; a first bypass flow path configured to connect the tank-side supply flow path and the tank-side circulation flow path; a head-side supply flow path configured to supply the ink from the sub tank to the head; a first pump provided in the tank-side supply flow path; and the processor, to drive the first pump and perform printing-time circulation processing that circulates the ink in the main tank, the tank-side supply flow path, the first bypass flow path and the tank-side circulation flow path, when printing is performed by ejecting the ink from the head.

In this case, when the printing is performed, it is possible to perform the printing-time circulation processing that circulates the ink in the main tank, the tank-side supply flow path, the first bypass flow path and the tank-side circulation flow path.

BRIEF DESCRIPTION OF THE DRAWINGS

Embodiments will be described below in detail with reference to the accompanying drawings in which.

DETAILED DESCRIPTION

Hereinafter, a printer 1 of a first embodiment of the present invention will be explained with reference to the drawings. An overview of the printer 1 will be explained with reference to FIG. 1. The upward direction, the downward direction, the left downward direction, the right upward direction, the right downward direction and the left upward direction in FIG. 1 respectively correspond to an upward direction, a downward direction, a front direction, a rear direction, a right direction and a left direction of the printer 1.

Figure 2:
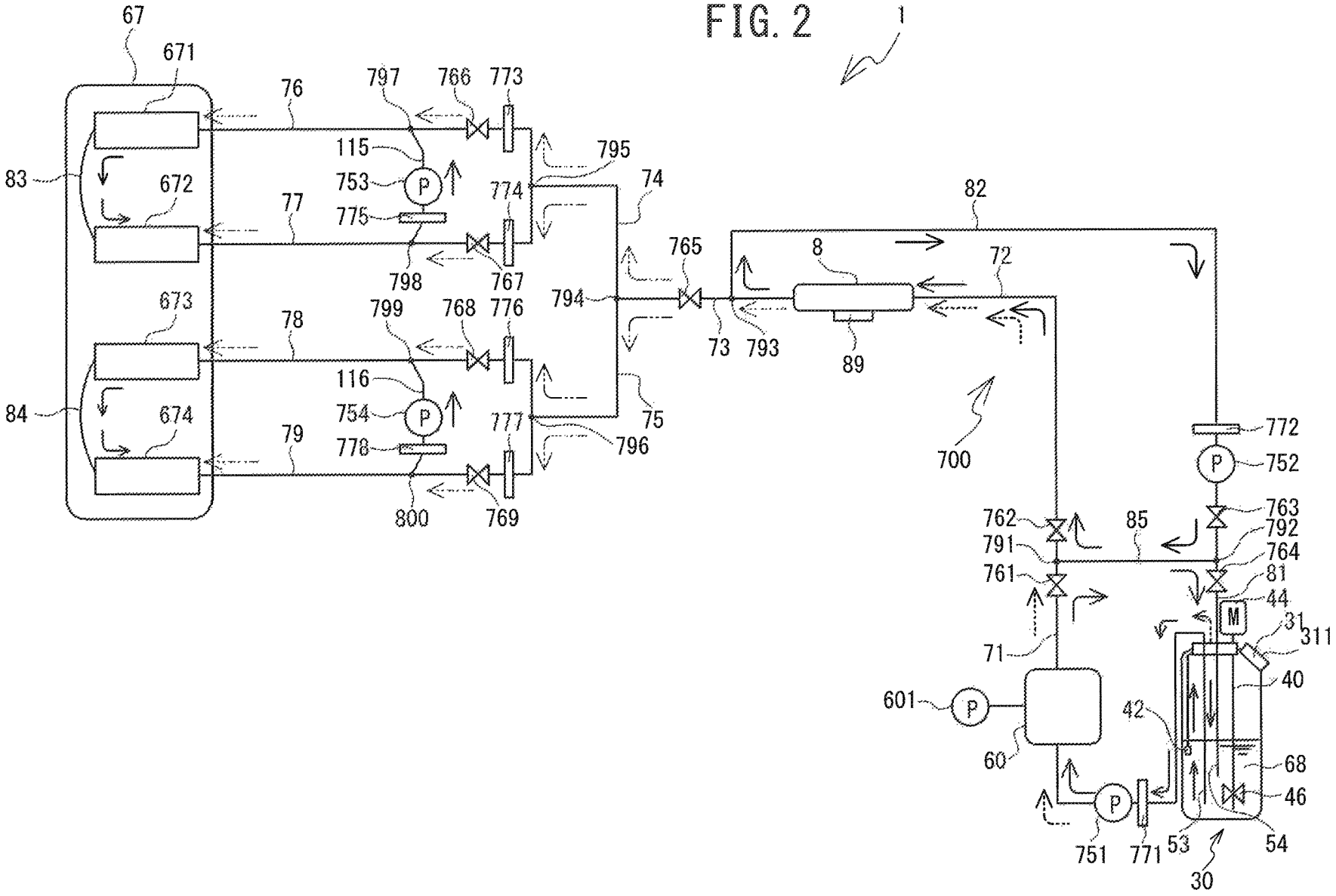
FIG. 2 is a diagram schematically showing a configuration of an ink supply flow path and an ink circulation flow path of the printer 1.

The printer 1 is an inkjet printer that performs printing on a fabric such as a T-shirt, or a recording medium such as paper, by ejecting an ink 68 (refer to FIG. 2) from nozzles (not shown in the drawings) of a head portion 67 (refer to FIG. 2). The printer 1 prints a color image on the recording medium by downwardly ejecting, for example, five different types of the ink 68 (white (W), black (K), yellow (Y), cyan (C) and magenta (M)). In the following explanation, of the five types of the ink 68, the white ink 68 is referred to as white ink. When the four colors of the ink 68, i.e., the black, cyan, yellow and magenta inks, are collectively referred to, they are referred to as color inks. The white ink is an ink having higher settleability than the color inks.

Figure 1:
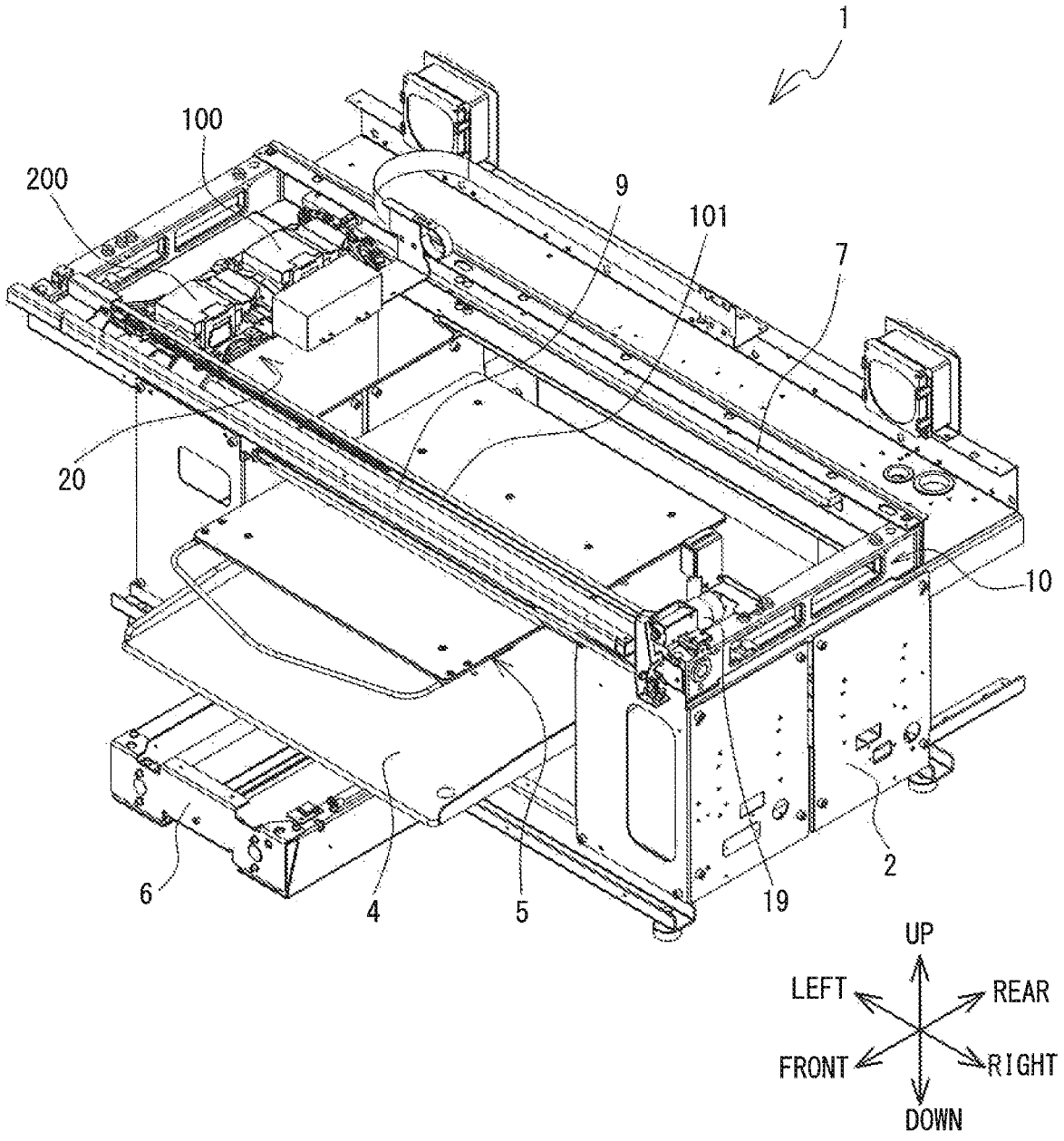
FIG. 1 is a perspective view of a printer 1.

As shown in FIG. 1, the printer 1 is provided with a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101 and a drive motor 19. An operation portion (not shown in the drawings) that is used to perform operations of the printer 1 is provided at a front position on the right side of the housing 2. The operation portion is operated when an operator inputs commands relating to various operations of the printer 1. Note that the operation on the operation portion may be an operation on a terminal, such as a personal computer (PC) connected to the printer 1.

The frame body 10 has a substantially rectangular frame shape in a plan view, and is installed on an upper portion of the housing 2. The frame body 10 supports the guide shaft 9 and the rail 7, respectively, at the front side and the rear side of the frame body 10. The guide shaft 9 extends in the left-right direction on the inside of the frame body 10. The rail 7 is disposed facing the guide shaft 9 and extends in the left-right direction.

The carriage 20 is supported such that it can be conveyed in the left-right direction along the guide shaft 9. The head units 100 and 200 are mounted on the carriage 20 such that they are aligned in the front-rear direction. The head unit 100 is positioned to the rear of the head unit 200. The head portion 67 (refer to FIG. 2) is provided on a lower portion of each of the head units 100 and 200. The head portion 67 of the head unit 100 ejects the white ink. The head portion 67 of the head unit 200 ejects the color inks. The head portion 67 is provided with a surface having the plurality of fine nozzles (not shown in the drawings) that can eject the ink 68 downward.

As shown in FIG. 1, the drive belt 101 is stretched along the left-right direction on the inside of the frame body 10. The drive motor 19 is coupled to the carriage 20 via the drive belt 101. When the drive motor 19 drives the drive belt 101, the carriage 20 is caused to reciprocate in the left-right direction along the guide shaft 9.

The platen drive mechanism 6 is provided with the pair of guide rails (not shown in the drawings) and a platen support base (not shown in the drawings). The pair of guide rails extend in the front-rear direction on the inside of the platen drive mechanism 6, and support the platen support base such that the platen support base can move in the front-rear direction. An upper portion of the platen support base supports the platen 5. The platen 5 supports the recording medium. The tray 4 is provided below the platen 5. When the operator places a T-shirt or the like on the platen 5, the tray 4 receives a sleeve or the like of the T-shirt, and thus protects the sleeve or the like such that the sleeve or the like does not come into contact with other components inside the housing 2. The platen drive mechanism 6 is driven by a sub-scanning drive portion (not shown in the drawings), and moves the platen support base and the platen 5 in the front-rear direction along the pair of guide rails. Printing by the printer 1 on the recording medium is performed by the platen 5 conveying the recording medium in the front-rear direction (a sub-scanning direction) and the ink 68 being ejected from the head portion 67 that is reciprocating in the left-right direction (a main scanning direction).

As shown in FIG. 2, the printer 1 is provided with the head portion 67, an ink supply portion 700 and a main tank 30. The ink supply portion 70 supplies the white ink 68 to the head portion 67. The head portion 67 is provided with inkjet type heads 671, 672, 673 and 674. An ink supply portion (not shown in the drawings) that supplies the other four colors of the ink 68 to the head portion 67 of the head unit 200 may have the same configuration as that shown in FIG. 2. The main tank 30 supplies the white ink 68 to the ink supply portion 700, and stores the ink 68 returned from the ink supply portion 700. Further, a shaft 40, a first tube 53, a second tube 54 and a remaining amount sensor 42 are inserted into the inside of the main tank 30. Further, the main tank 30 is provided with a replenishment port 31 to replenish the ink 68, and the replenishment port 31 is provided with a lid 311. A lid sensor (not shown in the drawings) that detects the opening and closing of the lid 311 is provided in the vicinity of the replenishment port 31.

Ink Supply Portion 700

As shown in FIG. 2, the ink supply portion 700 supplies the ink 68 to the head portion 67. Further, the ink supply portion 700 is a portion through which the ink 68 circulates. The ink supply portion 700 is provided with tank-side supply flow paths 71 and 72, tank-side circulation flow paths 81 and 82, a first bypass flow path 85, head-side supply flow paths 76, 77, 78 and 79, connection flow paths 73, 74 and 75, second bypass flow paths 115 and 116, third bypass flow paths 83 and 84, a sub tank 8, a deaeration portion 60, pumps 751, 752, 753 and 754, a pressure reducing pump 601, electromagnetic valves 761, 762, 763, 764, 765, 766, 767, 768 and 769, and filters 771, 772, 773, 774, 775, 776, 777 and 778. The deaeration portion 60 reduces air bubbles in the ink 68 that flows through the tank-side supply flow path 71 to be described later.

The sub tank 8 has a bag shape, for example, and stores the ink 68 supplied from the main tank 30. Further, as shown by two-dot chain lines in FIG. 2, the ink 68 is supplied from the sub tank 8 to the heads 671 to 674 via the connection flow paths 73 to 75 and the head-side supply flow paths 76 to 79. The heads 671 to 674 eject the ink 68 supplied from the sub tank 8, and perform printing on a print target. A remaining amount sensor 89 that detects a remaining amount of the ink 68 is mounted on the sub tank 8. The remaining amount sensor 89 is formed by a full sensor and an empty sensor that are not shown in the drawings. An example of the full sensor will be explained. For example, when the sub tank 8 is a pouch, an actuator that can operate in accordance with inflation of the pouch is disposed in the sub tank 8. When the pouch becomes full of the ink 68, the full sensor detects "FULL" for the ink 68 on the basis of displacement of the actuator. On the other hand, when the pouch becomes empty of the ink 68, the empty sensor detects "Empty" for the ink 68 on the basis of the displacement of the actuator.

The tank-side supply flow paths 71 and 72, the tank-side circulation flow paths 81 and 82, the first bypass flow path 85, the head-side supply flow paths 76, 77, 78 and 79, the connection flow paths 73, 74 and 75, and the second bypass flow paths 115 and 116 are formed by hollow tubes, for example. One end portion of the tank-side supply flow path 71 is connected to the first tube 53, and the other end portion of the tank-side supply flow path 71 is connected to one end portion of the tank-side supply flow path 72 at a connection portion 791. The other end portion of the tank-side supply flow path 72 is connected to the sub tank 8. Therefore, as shown by dotted lines in FIG. 2, the ink 68 is supplied from the main tank 30 to the sub tank 8 via the tank-side supply flow path 71 and the tank-side supply flow path 72.

One end portion of the tank-side circulation flow path 81 is connected to the second tube 54, and the other end portion of the tank-side circulation flow path 81 is connected to one end portion of the tank-side circulation flow path 82 at a connection portion 792. The other end portion of the tank-side circulation flow path 82 is connected to the sub tank 8. Therefore, the ink 68 is circulated from the sub tank 8 to the main tank 30 via the tank-side circulation flow path 81 and the tank-side circulation flow path 82. Further, one end portion of the first bypass flow path 85 is connected to the tank-side supply flow paths 71 and 72 at the connection portion 791, and the other end portion of the first bypass flow path 85 is connected to the tank-side circulation flow paths 81 and 82 at the connection portion 792. As shown by solid lines in FIG. 2, a main tank-side circulation flow path is formed by the main tank 30, the tank-side supply flow path 71, the first bypass flow path 85 and the tank-side circulation flow path 81. Further, a sub tank-side circulation flow path is formed by the tank-side supply flow path 72, the sub tank 8, the tank-side circulation flow path 82 and the first bypass flow path 85.

One end portion of the connection flow path 73 is connected to the tank-side circulation flow path 82 at a connection portion 793, and the other end portion of the connection flow path 73 is connected to one end portion of the connection flow path 74 and to one end portion of the connection flow path 75 at a connection portion 794. The other end portion of the connection flow path 74 is connected to one end portion of the head-side supply flow path 76 and to one end portion of the head-side supply flow path 77 at a connection portion 795. The other end portion of the head-side supply flow path 76 is connected to the head 671 so as to supply the ink 68 to the head 671. The other end portion of the head-side supply flow path 77 is connected to the head 672 so as to supply the ink 68 to the head 672. The third bypass flow path 83 connects an ink flow path (not shown in the drawings) provided inside the head 671 and an ink flow path (not shown in the drawings) provided inside the head 672.

Further, the other end portion of the connection flow path 75 is connected to one end portion of the head-side supply flow path 78 and to one end portion of the head-side supply flow path 79 at a connection portion 796. The other end portion of the head-side supply flow path 78 is connected to the head 673 so as to supply the ink 68 to the head 673. The other end portion of the head-side supply flow path 79 is connected to the head 674 so as to supply the ink 68 to the head 674. The third bypass flow path 84 connects an ink flow path (not shown in the drawings) provided inside the head 673 and an ink flow path (not shown in the drawings) provided inside the head 674. Note that the head 671 and the head 672 may be a plurality of heads or may be a single head, and it is sufficient that the head 671 and the head 672 have an ink flow path through which the ink 68 supplied from one of the head-side supply flow path 76 and the head-side supply flow path 77 flows to the other. This also applies to the head 673 and the head 674.

One end portion of the second bypass flow path 115 is connected to the head-side supply flow path 76 at a connection portion 797. The other end portion of the second bypass flow path 115 is connected to the head-side supply flow path 77 at a connection portion 798. Therefore, as shown by the solid lines in FIG. 2, a first head-side circulation flow path is formed by the second bypass flow path 115, the head-side supply flow path 76, the head 671, the third bypass flow path 83, the head 672 and the head-side supply flow path 77. Further, one end portion of the second bypass flow path 116 is connected to the head-side supply flow path 78 at a connection portion 799. The other end portion of the second bypass flow path 116 is connected to the head-side supply flow path 79 at a connection portion 800. Therefore, as shown by the solid lines in FIG. 2, a second head-side circulation flow path is formed by the second bypass flow path 116, the head-side supply flow path 78, the head 673, the third bypass flow path 84, the head 674 and the head-side supply flow path 79.

The electromagnetic valve 761 is provided in the tank-side supply flow path 71, between the deaeration portion 60 and the connection portion 791. The electromagnetic valve 761 is controlled by a CPU 70 (refer to FIG. 3) to be described later and opens and closes the tank-side supply flow path 71. The electromagnetic valve 762 is provided in the tank-side supply flow path 72, between the connection portion 791 and the sub tank 8. The electromagnetic valve 762 is controlled by the CPU 70 and opens and closes the tank-side supply flow path 72. The electromagnetic valve 763 is provided in the tank-side circulation flow path 82. The electromagnetic valve 763 is controlled by the CPU 70 and opens and closes the tank-side circulation flow path 82. The electromagnetic valve 764 is provided in the tank-side circulation flow path 81. The electromagnetic valve 764 is controlled by the CPU 70 and opens and closes the tank-side circulation flow path 81.

The electromagnetic valve 765 is provided in the connection flow path 73, is controlled by the CPU 70, and opens and closes the connection flow path 73. The electromagnetic valves 766 to 769 are respectively provided in the head-side supply flow paths 76 to 79, are controlled by the CPU 70, and open and close the head-side supply flow paths 76 to 79.

The filter 771 is provided in the tank-side supply flow path 71, between the main tank 30 and the pump 751 to be described later. The filter 772 is provided in the tank-side circulation flow path 82, between the sub tank 8 and the pump 752 to be described later. The filter 773 is provided in the head-side supply flow path 76, between the connection portion 795 and the electromagnetic valve 766. The filter 774 is provided in the head-side supply flow path 77, between the connection portion 795 and the electromagnetic valve 767. The filter 775 is provided in the second bypass flow path 115, between the connection portion 798 and the pump 753 to be described later. The filter 776 is provided in the head-side supply flow path 78, between the connection portion 796 and the electromagnetic valve 768. The filter 777 is provided in the head-side supply flow path 79, between the connection portion 796 and the electromagnetic valve 769. The filter 778 is provided in the second bypass flow path 116, between the connection portion 800 and the pump 754 to be described later. Note that the filters 771 to 778 remove foreign matter contained in the ink 68 that flows through the flow paths in which the filters 771 to 778 are respectively provided.

The pump 751 is provided in the tank-side supply flow path 71, between the deaeration portion 60 and the filter 771. The pump 751 is controlled by the CPU 70, sucks up the ink 68 from the main tank 30, and causes the ink 68 to flow to the sub tank 8 side, which is a downstream side. The pump 752 is provided in the tank-side circulation flow path 82, between the filter 772 and the electromagnetic valve 763. The pump 752 is controlled by the CPU 70 and causes the ink 68 to flow from the sub tank 8 to the main tank 30. The pump 753 is provided in the second bypass flow path 115, between the filter 775 and the connection portion 797. The pump 753 is controlled by the CPU 70 and circulates the ink 68 in the first head-side circulation flow path. The pump 754 is provided in the second bypass flow path 116, between the filter 778 and the connection portion 799. The pump 754 is controlled by the CPU 70 and circulates the ink 68 in the second head-side circulation flow path.

The pressure reducing pump 601 is connected to the deaeration portion 60. The pressure reducing pump 601 is controlled by the CPU 70 and depressurizes the deaeration portion 60. Therefore, air bubbles contained in the ink 68 that flows through the deaeration portion 60 are reduced.

Electrical Configuration of Printer 1

Figure 3:
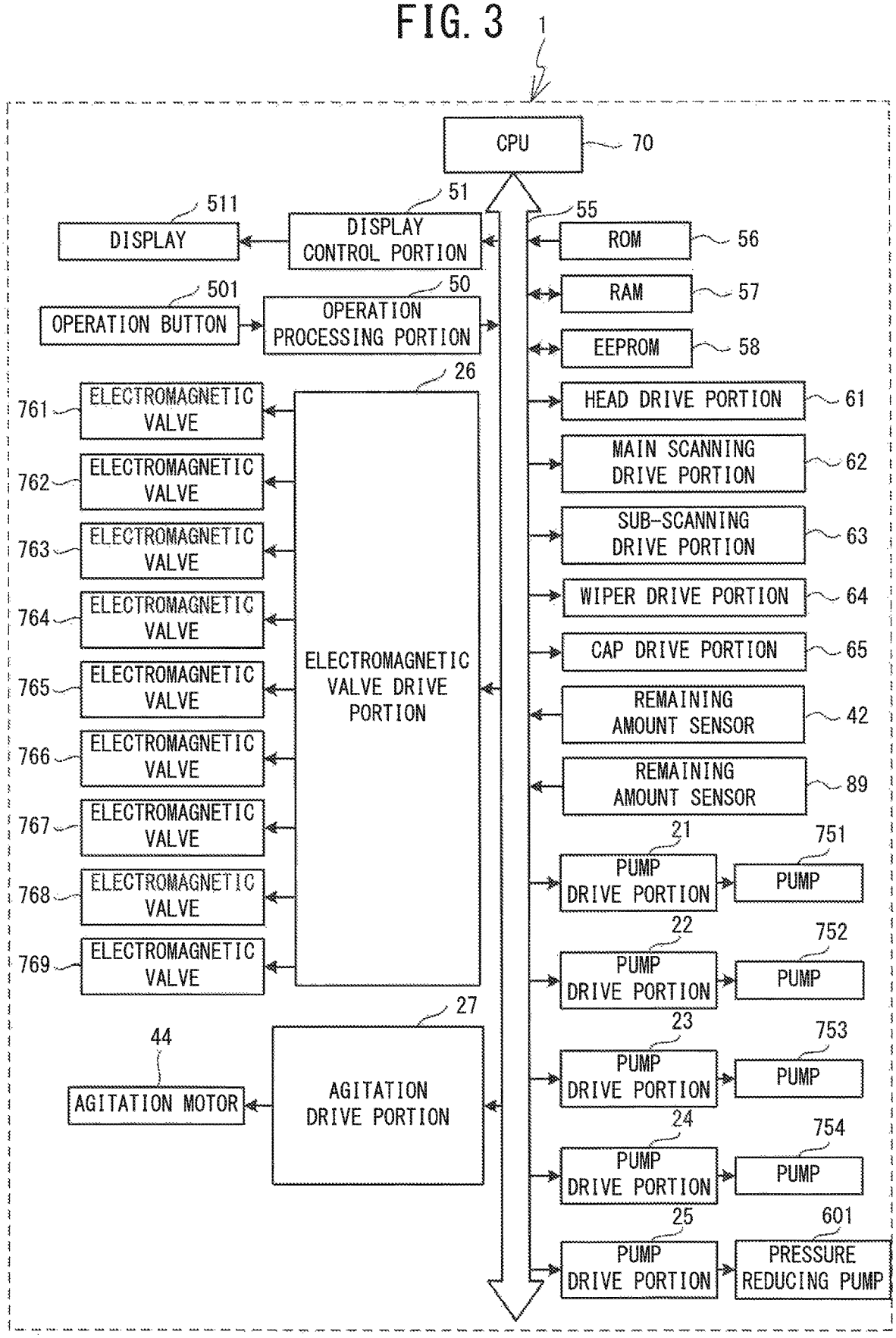
FIG. 3 is a block diagram showing an electrical configuration of the printer 1.

An electrical configuration of the printer 1 will be explained with reference to FIG. 3. The printer 1 is provided with the CPU 70 that controls the printer 1. A ROM 56, a RAM 57, an EEPROM 58, a head drive portion 61, a main scanning drive portion 62, a sub-scanning drive portion 63, a wiper drive portion 64, a cap drive portion 65, the remaining amount sensor 42, the remaining amount sensor 89, pump drive portions 21, 22, 23, 24 and 25, a display control portion 51, an operation processing portion 50, an electromagnetic valve drive portion 26 and an agitation drive portion 27 are electrically connected to the CPU 70 via a bus 55.

The ROM 56 stores a control program, initial values and the like that are used by the CPU 70 to control operations of the printer 1. The RAM 57 temporarily stores various data that are used in the control program, and print data. The EEPROM 58 stores a date and time at which agitation processing (step S5), normal circulation processing (step S8) and main tank-side circulation processing (step S17), which will be described later, are performed, and stores a date and time at which the printer 1 is put into a stopped state. The head drive portion 61 is electrically connected to the head portion 67 that ejects the ink 68. The head drive portion 61 drives piezoelectric elements that are respectively provided in ejection channels of the heads 671 to 674 of the head portion 67, and causes the ink 68 to be ejected from the nozzles (not shown in the drawings).

The main scanning drive portion 62 includes the drive motor 19 (refer to FIG. 1) and causes the carriage 20 to move in the main scanning direction. The sub-scanning drive portion 63 uses a drive motor (not shown in the drawings) to drive the platen drive mechanism 6 (refer to FIG. 1), and causes the platen 5 (refer to FIG. 1) to move in the sub-scanning direction.

The CPU 70 controls the display control portion 51 and displays an image on a display 511. The operation processing portion 50 outputs, to the CPU 70, a signal that is based on an operation of an operation button 501 by a user. The remaining amount sensor 42 outputs, to the CPU 70, a signal indicating a remaining amount of the ink 68 in the main tank 30. The remaining amount sensor 89 outputs, to the CPU 70, a signal indicating a remaining amount (full or empty) of the ink 68 in the sub tank 8.

The CPU 70 controls the opening and closing of the electromagnetic valves 761 to 769 via the electromagnetic valve drive portion 26, and opens and closes the tank-side supply flow paths 71 and 72, the tank-side circulation flow paths 81 and 82, the connection flow path 73, and the head-side supply flow paths 76 to 79. Each of the electromagnetic valves 761 to 769 can be individually controlled. The CPU 70 controls the pump drive portions 21 to 25 and drives the pumps 751 to 754 and the pressure reducing pump 601, respectively. The pumps 751 to 754 and the pressure reducing pump 601 can be respectively and individually controlled. Further, the CPU 70 controls the wiper drive portion 64 and performs wiping of nozzle surfaces (not shown in the drawings) using wipers (not shown in the drawings). Further, the CPU 70 controls the cap drive portion 65 and performs capping of the nozzle surfaces (not shown in the drawings) using caps (not shown in the drawings).

Ink Circulation Processing

Ink circulation processing will be explained with reference to FIG. 4. In the printer 1, the ink circulation processing is performed in order to remove air bubbles contained in the ink 68 in the ink flow paths and to eliminate sedimentation of ink components, such as pigments. For example, when a power source of the printer 1 is turned on, the CPU 70 reads out, from the ROM 56, a program for main processing (not shown in the drawings) that performs main control of a printing operation etc. of the printer 1, a program for the ink circulation processing, and the like, and loads the programs to the RAM 57. In accordance with the programs, the CPU 70 performs the main processing and the ink circulation processing.

Figure 4:
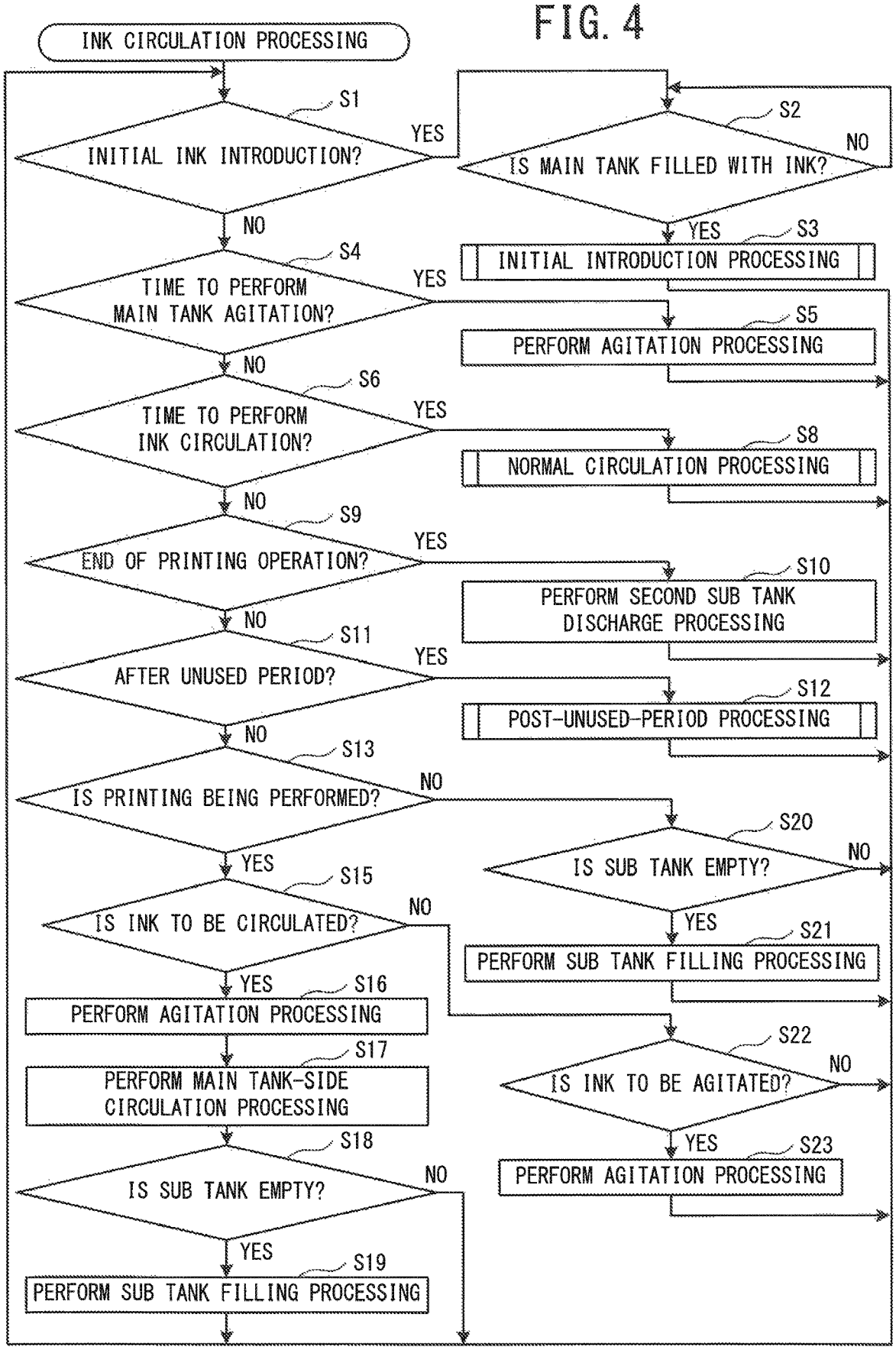
FIG. 4 is a flowchart of ink circulation processing.

As shown in FIG. 4, in the ink circulation processing, first, the CPU 70 determines whether to perform initial ink introduction (step S1). The initial ink introduction is processing in which the user introduces the ink 68 into the main tank 30 and causes the sub tank 8 to be filled with the ink 68. When the operation button 501 is operated and a command for the initial ink introduction is received from the operation processing portion 50, the CPU 70 determines that the initial ink introduction is to be performed (yes at step S1). Next, the CPU 70 determines whether or not the main tank 30 is filled with the ink 68 (step S2). For example, when the CPU 70 receives, from the remaining amount sensor 42 of the main tank 30, a signal indicating that the main tank 30 is filled with a predetermined amount of the ink 68, the CPU 70 determines that the main tank 30 is filled with the ink 68 (yes at step S2). When the CPU 70 does not receive this signal from the remaining amount sensor 42 (no at step S2), the CPU 70 returns the processing to step S2.

Figure 5:
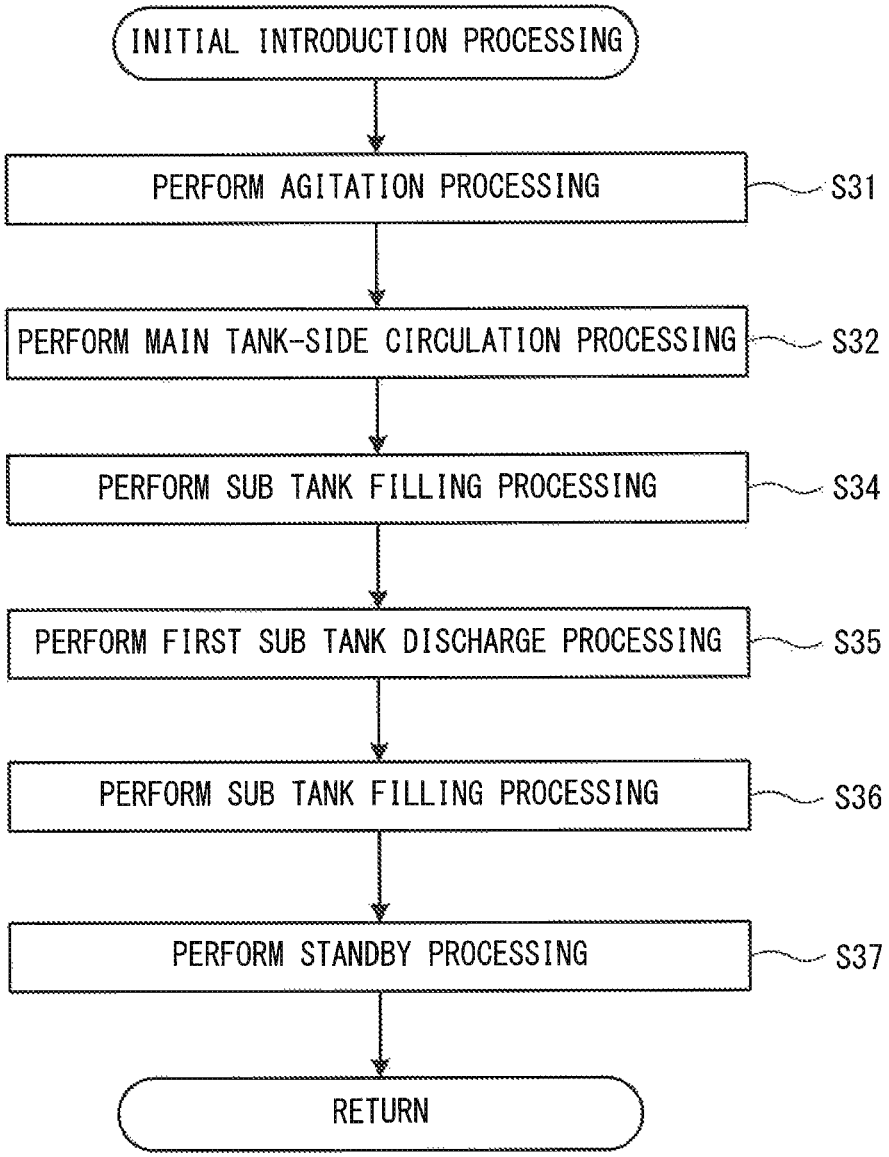
FIG. 5 is a subroutine of initial introduction processing.

Next, when the CPU 70 determines that the main tank 30 is filled with the ink 68 (yes at step S2), the CPU 70 performs initial introduction processing (step S3). The initial introduction processing will be explained with reference to FIG. 5. First, the CPU 70 performs agitation processing (step S31) of the ink 68 in the main tank 30. For example, the CPU 70 controls the agitation drive portion 27 and rotates an agitation motor 44 for a certain time period. Thus, the ink 68 in the main tank 30 is agitated by an agitation blade 46. An example of the certain time period is thirty minutes. Next, the CPU 70 performs main tank-side circulation processing (step S32). In the main tank-side circulation processing, first, the CPU 70 controls the electromagnetic valve drive portion 26, opens the electromagnetic valves 761 and 764, and closes the electromagnetic valves 762 and 763. Next, the CPU 70 drives the pressure reducing pump 601 by controlling the pump drive portion 25, and depressurizes the deaeration portion 60. Next, the CPU 70 controls the pump drive portion 21 and drives the pump 751. Thus, as shown by the solid lines in FIG. 2, the circulation of the ink 68 is performed in the main tank-side circulation flow path for the certain time period.

When the ink supply portion 700 is provided with the first bypass flow path 85, even when the ink 68 is circulated in order of the main tank 30, the tank-side supply flow path 71, the tank-side supply flow path 72, the sub tank 8, the tank-side circulation flow path 82 and the tank-side circulation flow path 81, air bubbles in the first bypass flow path 85 are unlikely to be discharged. Therefore, the CPU 70 drives the pump 751 by controlling the pump drive portion 21, and performs the main tank-side circulation processing of the ink 68 for a certain time period in the main tank-side circulation flow path. Thus, the air bubbles in the first bypass flow path 85 are returned from the tank-side circulation flow path 81 to the main tank 30, together with the ink 68. Further, the air bubbles (air) contained in the ink 68 are deaerated by the deaeration portion 60. An example of the certain time period is five minutes. Next, the CPU 70 stops the pump 751. Then, the CPU 70 performs sub tank filling processing (step S34).

In the sub tank filling processing (step S34), first, the CPU 70 closes the electromagnetic valve 765, opens the electromagnetic valves 761 and 762, and closes the electromagnetic valves 763 and 764. Next, the CPU 70 drives the pressure reducing pump 601 by controlling the pump drive portion 25, and depressurizes the deaeration portion 60. Next, the CPU 70 drives the pump 751 by controlling the pump drive portion 21, and fills the sub tank 8 with the ink 68 from the main tank 30, as shown by the dotted lines in FIG. 2. Next, the CPU 70 determines whether the sub tank 8 is full of the ink 68. For example, when a signal indicating that the sub tank 8 is full of the ink 68 is received from the remaining amount sensor 89, the CPU 70 determines that the sub tank 8 is full. Next, the CPU 70 stops the pump 751 and the pressure reducing pump 601.

When the ink 68 is initially introduced into the sub tank 8 by the sub tank filling processing (step S34), air is contained in the sub tank 8 and the air bubbles are likely to remain. Further, when the sub tank 8 is formed by a pouch, if the pouch inflates, the air bubbles accumulate in corners etc. of the pouch and are unlikely to pass through the pouch. Therefore, in order to discharge the air bubbles in the sub tank 8, the CPU 70 performs first sub tank discharge processing (step S35). In the first sub tank discharge processing, first, the CPU 70 closes the electromagnetic valves 761 and 762 and opens the electromagnetic valves 763 and 764. Next, the CPU 70 drives the pump 752 by controlling the pump drive portion 22, and returns the ink 68 from the sub tank 8 to the main tank 30. Next, the CPU 70 determines whether the sub tank 8 is empty of the ink 68. For example, when a signal indicating that the sub tank 8 is empty of the ink 68 is received from the remaining amount sensor 89, the CPU 70 determines that the sub tank 8 is empty. Next, the CPU 70 controls the pump drive portion 22 and stops the pump 752.

Next, the CPU 70 performs sub tank filling processing (step S36). After the first sub tank discharge processing (step S35) is performed in the initial introduction processing, the sub tank 8 is in a deflated state. Therefore, it is necessary to replenish the sub tank 8 with the ink 68 in order to prepare for the printing. The processing at step S36 is the same as the processing at step S34, and an explanation thereof is thus omitted here. Next, the CPU 70 performs standby processing (step S37). In the standby processing, the CPU 70 opens the electromagnetic valves 765 to 769 and closes the electromagnetic valves 761 to 764. Next, the CPU 70 ends the initial introduction processing (step S3) and returns the processing to step S1.

Next, when the CPU 70 determines that the initial ink introduction is not to be performed (no at step S1), the CPU 70 determines whether it is a time to perform main tank agitation (step S4). For example, in the determination processing at step S4, the CPU 70 determines whether a certain time period has elapsed from the time of the previous agitation processing (step S5) stored in the EEPROM 58. An example of the certain time period is one hour. The agitation processing (step S5) is processing in which the ink 68 in the main tank 30 is agitated by the agitation blade 46. When the CPU 70 performs the agitation processing (step S5), the CPU 70 stores the time in the EEPROM 58. When the CPU 70 determines that it is the time to perform the main tank agitation (yes at step S4), the CPU 70 performs the agitation processing (step S5). The agitation processing (step S5) is the same as the agitation processing (step S31) shown in FIG. 5, except an agitation time period. An example of the agitation time period at step S5 is five minutes. Next, the CPU 70 returns the processing to step S1.

Figure 6:
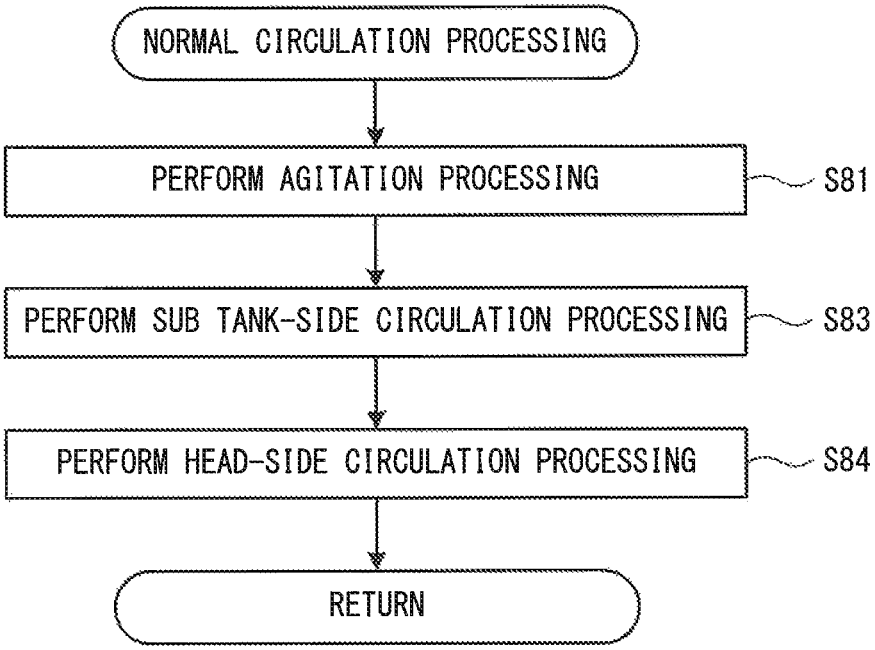
FIG. 6 is a subroutine of normal circulation processing.

When the CPU 70 determines "NO" in the determination processing at step S4, the CPU 70 determines whether it is a time to perform ink circulation (step S6). For example, in the determination processing at step S6, the CPU 70 determines whether a certain time period has elapsed from the time of the previous normal circulation processing (step S8) stored in the EEPROM 58. An example of the certain time period is six hours. When the CPU 70 determines that it is the time to perform the ink circulation (yes at step S6), the CPU 70 performs the normal circulation processing (step S8). The normal circulation processing will be explained with reference to FIG. 6. First, the CPU 70 performs agitation processing (step S81). The agitation processing (step S81) is the same as the agitation processing (step S5), and an explanation thereof is thus omitted here. Next, the CPU 70 starts sub tank-side circulation processing (step S83). Next, the CPU 70 starts head-side circulation processing (step S84). When the head-side circulation processing is started, the sub tank-side circulation processing may be continued or ended. In the sub tank-side circulation processing, first, the CPU 70 closes the electromagnetic valves 765, 761 and 764 and opens the electromagnetic valves 762 and 763, thus forming the sub tank-side circulation flow path. Next, the CPU 70 drives the pump 752 and performs the circulation of the ink 68 for a certain time period in the sub tank-side circulation flow path. An example of the certain time period is three minutes. Next, the CPU 70 stops the pump 752.

In the head-side circulation processing, first, the CPU 70 closes the electromagnetic valves 766, 767, 768 and 769 and forms the first head-side circulation flow path and the second head-side circulation flow path. Note that the electromagnetic valve 765 may be in a closed state or in an open state. The CPU 70 drives the pump 753 and performs head-side circulation, in which the ink 68 is circulated in the first head-side circulation flow path, for a certain time period, as shown by the solid lines in FIG. 2. Further, the CPU 70 drives the pump 754 and performs head-side circulation, in which the ink 68 is circulated in the second head-side circulation flow path, for a certain time period, as shown by the solid lines in FIG. 2. Note that an example of each of the certain time periods is three minutes. Note that, next, the CPU 70 stores the time in the EEPROM 58 and returns the processing to step S1.

Next, when the CPU 70 determines "NO" in the determination processing at step S6, the CPU 70 determines whether to end the printing operation (step S9). In the printer 1, after the end of the printing operation, when a time period during which the ink 68 is not ejected from the nozzles (not shown in the drawings) of the heads 671 to 674 exceeds a predetermined time period, there is a possibility that sedimentation of components of the ink 68 in the sub tank 8 may occur. In order to resolve the sedimentation of the components of the ink 68 in the sub tank 8, the circulation can be considered, for example. However, the circulation requires a certain time period. Therefore, after the end of the printing operation, since the remaining amount of the ink 68 in the sub tank 8 is reduced, the printer 1 can also reduce the sediment of the ink 68 in the sub tank 8. When the operation button 501 is operated and a command to end the printing operation is received from the operation processing portion 50, the CPU 70 determines that the printing operation is to be ended (yes at step S9), and performs second sub tank discharge processing (step S10). The processing at step S10 is the same as the first sub tank discharge processing (step S35), and an explanation thereof is thus omitted here. Next, the CPU 70 performs the capping of the nozzle surfaces (not shown in the drawings) of the heads 671 to 674 by causing the cap drive portion 65 to drive the caps (not shown in the drawings), and puts the printer 1 into the stopped state. The CPU 70 stores the time at which the printer 1 is put into the stopped state in the EEPROM 58.

Figure 7:
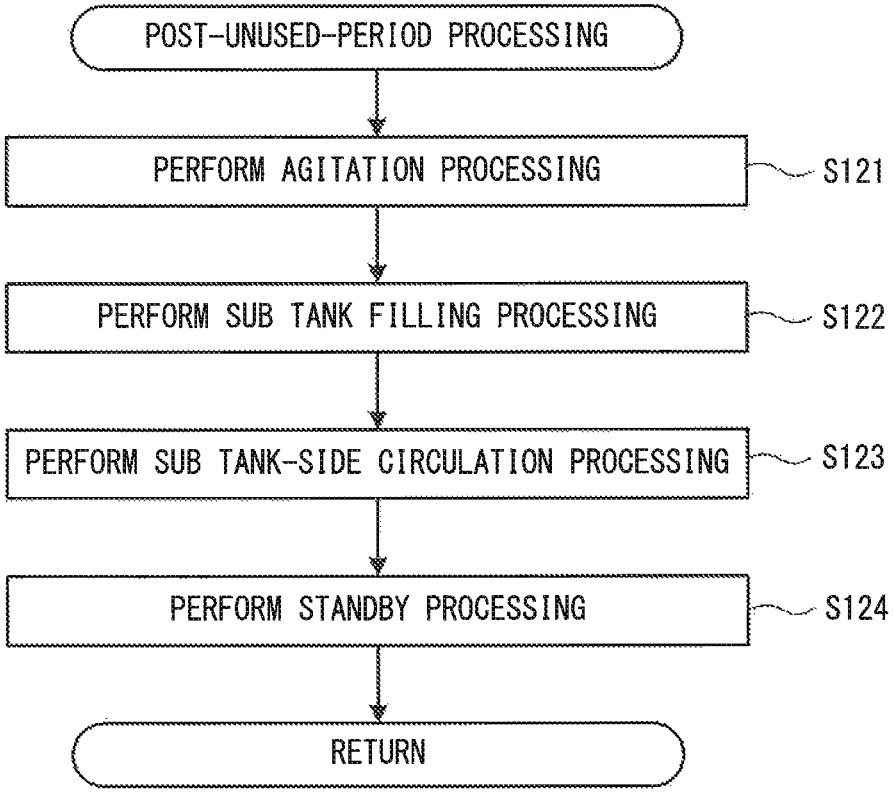
FIG. 7 is a subroutine of post-unused-period processing.

When the CPU 70 determines "NO" in the determination processing at step S9, the CPU 70 determines whether the printer 1 has been left unused for a certain time period (step S11). Note that, in the present embodiment, in an unused state for the certain time period, the printer 1 is in the stopped state. The stopped state is, for example, a state in which the power source of the printer 1 is OFF. For example, when the CPU 70 determines that the certain time period has elapsed from the time at which the printer 1 is put into the stopped state stored in the EEPROM 58, the CPU 70 determines that the printer 1 has been left unused (yes at step S11) and performs post-unused-period processing (step S12). The post-unused-period processing will be explained with reference to FIG. 7. First, the CPU 70 performs agitation processing (step S121). As the preparation for the printing, it is necessary for the ink 68 in the main tank 30 that is located on the most upstream side of the ink supply portion 700 to be in a uniform state as a result of the sedimentation being resolved before the ink 68 is supplied to the downstream side of the ink supply portion 700. For that reason, the agitation processing (step S121) is a processing operation that is performed before the printing operation is started after the printer 1 has been left unused. The agitation processing (step S121) is the same as the processing at step S31, and an explanation thereof is thus omitted here.

Next, the CPU 70 performs sub tank filling processing (step S122). The sub tank filling processing (step S122) is the same as the sub tank filling processing (step S34), and an explanation thereof is thus omitted here. Next, the CPU 70 performs sub tank-side circulation processing (step S123). The sub tank-side circulation processing (step S123) is the same as the sub tank-side circulation processing (step S83) except the time period, and an explanation thereof is thus omitted here. The circulation time period of the sub tank-side circulation processing (step S123) is longer than that of the processing at step S83, and is ten minutes, for example. Next, the CPU 70 performs standby processing (step S124). The standby processing (step S124) is the same as the standby processing (step S37) shown in FIG. 5, and an explanation thereof is thus omitted here. Note that, when the standby processing (step S37) is performed, the CPU 70 may perform flushing processing, wiping processing and the like of the heads 671 to 674. Next, the CPU 70 returns the processing to step S1.

When the CPU 70 determines "NO" in the determination at step S11, the CPU 70 determines whether the printing is being performed (step S13). For example, when the printing operation is started, the CPU 70 stores "ON" of a printing flag in the RAM 57, and when the printing operation is ended, the CPU 70 stores "OFF" of the printing flag in the RAM 57. Therefore, when the printing flag is ON, the CPU 70 determines that the printing is being performed (yes at step S13). When the CPU 70 determines that the printing is being performed (yes at step S13), the CPU 70 determines whether to perform ink circulation (step S15). For example, the CPU 70 determines that the ink circulation is to be performed (yes at step S15) when one of the following cases occurs: a case in which the operation button 501 is operated and a command to perform the main tank-side circulation processing is received from the operation processing portion 50; a case in which the command to perform the main tank-side circulation processing is received from a PC connected to the printer 1; a case in which the main tank-side circulation processing is commanded by the program; a case in which a signal indicating that the main tank 30 has been replenished with the ink 68 is received; and a case in which a signal indicating that the sub tank 8 is to be filled with the ink 68. It is conceivable that the case in which the signal indicating that the main tank 30 has been replenished with the ink 68 is, for example, a case in which the remaining amount sensor 42 detects that the amount of the ink 68 in the main tank 30 is larger than a certain amount, or a case in which a signal indicating that the lid 311 of the main tank 30 is closed is received from the lid sensor (not shown in the drawings). It is conceivable that the case in which the signal indicating that the sub tank 8 is to be filled with the ink 68 is, for example, a case in which a signal indicating that the remaining amount of the ink 68 is equal to or less than a certain amount (hereinafter also referred to as "sub tank empty") is received from the remaining amount sensor 89 of the sub tank 8.

When the amount of the ink 68 in the main tank 30 is greater than the certain amount, and when the lid 311 of the main tank 30 is closed, the main tank 30 is replenished with the ink 68, and it is necessary to perform the agitation processing and the circulation processing of the ink 68. Further, in the case of "sub tank empty", it is desirable to perform the agitation processing and the circulation processing of the ink 68 on the main tank 30 side, in preparation for the filling of the sub tank 8 with the ink 68. When the CPU 70 determines "YES" in the determination at step S15, the CPU 70 performs agitation processing (step S16). The agitation processing (step S16) is the same as the agitation processing (step S31), and an explanation thereof is thus omitted here. Next, the CPU 70 performs main tank-side circulation processing (step S17). The main tank-side circulation processing (step S17) is the same as the main tank-side circulation processing (step S32), and an explanation thereof is thus omitted here. Note that, even when the printing is being performed and the printing flag ON is stored in the RAM 57, the CPU 70 performs the main tank-side circulation processing (step S17) in parallel with the printing operation. An example of the time period of the main tank-side circulation processing is three minutes. Next, the CPU 70 stores, in the EEPROM 58, the time at which the main tank-side circulation process is ended.

Next, the CPU 70 determines whether the "sub tank empty" state has occurred (step S18). For example, when the signal indicating "sub tank empty" is received from the remaining amount sensor 89 of the sub tank 8, the CPU 70 determines that the "sub tank empty" state has occurred (yes at step S18). Next, when the printing flag becomes OFF, the CPU 70 performs sub tank filling processing (step S19). The sub tank filling processing (step S19) is the same as the sub tank filling processing (step S34), and an explanation thereof is thus omitted here. Next, the CPU 70 returns the processing to step S1. Further, also when the CPU 70 determines "NO" in the determination processing at step S18, the CPU 70 returns the processing to step S1.

Note that, when the CPU 70 determines "NO" in the determination processing at step S13, the CPU 70 determines whether the "sub tank empty" state has occurred (step S20). The determination processing at step S20 is the same as the determination processing at step S18, and an explanation thereof is thus omitted here. When the CPU 70 determines "YES" in the determination processing at step S20, the CPU 70 performs sub tank filling processing (step S21). The sub tank filling processing (step S21) is the same as the sub tank filling processing (step S34), and an explanation thereof is thus omitted here. The CPU 70 returns the processing to step S1 after the processing at step S21. Further, when the CPU 70 determines "NO" in the determination processing at step S15, the CPU 70 determines whether to agitate the ink 68 in the main tank 30 (step S22). For example, the CPU 70 determines that the agitation is to be performed (yes at step S22) when one of the following cases occurs: a case in which the operation button 501 is operated and a command to perform the agitation processing is received from the operation processing portion 50; a case in which the command to perform the agitation processing is received from a PC connected to the printer 1; and a case in which the agitation processing is commanded by the program. When the CPU 70 determines "YES" in the determination processing at step S22, the CPU 70 performs agitation processing (step S23). The agitation processing (step S23) is the same as the agitation processing (step S5), and an explanation thereof is thus omitted here. Next, the CPU 70 returns the processing to step S1.

As explained above, in the printer 1, when the printing is performed by ejecting the ink 68 from the heads 671 to 674, the CPU 70 performs the main tank-side circulation processing (step S17) that circulates the ink 68 in the tank-side circulation flow path, in parallel with the printing operation. Therefore, the printer 1 can perform the main tank-side circulation processing (step S17) without waiting for the end of the printing. It is thus possible to quickly replenish the sub tank 8 with the ink 68 that decreases during the printing.

Further, in the printer 1, the deaeration portion 60, which removes air from the ink 68, is provided in the tank-side supply flow path 71. The CPU 70 drives the deaeration portion 60 and performs the main tank-side circulation processing (step S17). Thus, in the main tank-side circulation processing (step S17), the printer 1 can perform the processing that removes air from the circulating ink 68. It is thus possible to accumulate the deaerated ink 68 in advance in the main tank 30 before the ink 68 is supplied from the main tank 30 to the sub tank 8. Further, when the ink 68 is supplied to the sub tank 8, the ink 68 that has already been deaerated can be supplied, and it is possible to shorten a time period required for the ink supply to the sub tank 8.

Further, in the printer 1, before the main tank-side circulation processing (step S17), the CPU 70 performs the main tank-side circulation processing (step S32) that circulates the ink 68, and after the main tank-side circulation processing, the CPU 70 performs the sub tank filling processing (step S36). In this manner, since the main tank-side circulation processing is performed before the sub tank filling processing, it is possible to reduce the air bubbles and the precipitated ink components in the ink 68 that is supplied from the main tank 30 to the sub tank 8.

Further, in the printer 1, before the sub tank filling processing (step S36), the CPU 70 performs the first sub tank discharge processing (step S35). Therefore, by performing the first sub tank discharge processing, it is possible to reduce the ink 68 that may contain the air bubbles and the precipitated ink components inside the sub tank 8. It is thus is possible to further reduce the air bubbles and the precipitated ink components in the ink 68 in the sub tank 8 after the sub tank filling processing (step S36).

Further, in the printer 1, in the end determination processing (step S9), when it is determined that the printing operation is to be ended (yes at step S9), the CPU 70 performs the second sub tank discharge processing (step S10) that returns the ink 68 from the sub tank 8 to the main tank 30. When the ink 68 is not ejected for the predetermined time period, the possibility of the occurrence of sedimentation of the ink components in the sub tank 8 becomes higher. Further, in order to eliminate the sedimentation of the ink components in the sub tank 8, it takes time to perform the sub tank-side circulation processing. On the other hand, when it is determined that the printing operation is to be ended in the end determination processing, the ink 68 in the sub tank 8 is returned to the main tank 30 by the second sub tank discharge processing. Thus, when the ink 68 is supplied from the main tank 30 to the sub tank 8, it is possible to shorten the time period necessary to eliminate the sedimentation of the ink components in the sub tank 8.

Further, in the printer 1, the CPU 70 performs the sub tank-side circulation processing (step S83) and the head-side circulation processing (step S84) at a predetermined time interval. Therefore, the time period required for the sub tank-side circulation processing and the head-side circulation processing can be shortened, in comparison to when the sub tank-side circulation processing and the head-side circulation processing are performed separately.

Further, in the printer 1, the CPU 70 performs the agitation processing (step S16) before the main tank-side circulation processing (step S17). Therefore, since the agitation processing of the ink 68 in the main tank 30 is performed before the main tank-side circulation processing, it is possible to agitate the ink components precipitated in the main tank 30. Thus, by performing the main tank-side circulation processing, it is possible to reduce the precipitated components in the ink 68 that is circulated.

Further, in the printer 1, the CPU 70 performs the agitation processing (step S31) before the main tank-side circulation processing (step S32). It is therefore possible to reduce the precipitated ink components in the ink 68 that is circulated by the main tank-side circulation processing. Further, since the agitation processing is performed before the main tank-side circulation processing, even when the ink 68 in the main tank 30 ripples due to the agitation processing, the main tank-side circulation processing is not performed simultaneously, and it is possible to reduce the possibility of the circulation of the ink 68 containing air bubbles.

Note that the present invention is not limited to the above-described embodiment, and various modifications are possible. For example, the CPU 70 need not necessarily simultaneously perform the sub tank-side circulation processing (step S83) and the head-side circulation processing (step S84). The CPU 70 may start the sub tank-side circulation processing (step S83) before the head-side circulation processing (step S84), and may simultaneously end the sub tank-side circulation processing and the head-side circulation processing. Further, the CPU 70 may simultaneously perform the agitation processing (step S81), the sub-tank-side circulation processing (step S83) and the head-side circulation processing (step S84). Further, the CPU 70 may start the operation in order of the agitation processing (step S81), the sub tank-side circulation processing (step S83) and the head-side circulation processing (step S84), may perform these processing operations in parallel with each other, and may simultaneously end them. Further, the circulation time period of the head-side circulation processing (step S84) is not limited to three minutes, and may be appropriately set depending on sedimentation characteristics of the components of the ink 68 and a liquid feeding ability of the pumps 753 and 754.

In addition, the agitation time period of the agitation processing (step S31) is not limited to thirty minutes, and may be appropriately set depending on the amount of the ink 68 to be introduced into the main tank 30 and an agitation ability of the agitation blade 46. In the main tank-side circulation processing (step S32), the CPU 70 need not necessarily depressurize the deaeration portion 60 to create a state in which the deaeration is possible. The circulation time period of the main tank-side circulation processing (step S32) is not limited to five minutes, and may be appropriately set depending on the remaining amount of the ink 68 in the main tank 30 and the liquid feeding ability of the pump 751. The time interval of the agitation processing (step S5) is not limited to one hour. Further, the agitation time period of the agitation processing (step S5) is not limited to five minutes. The time interval and the agitation time period may be appropriately set depending on the sedimentation characteristics of the components of the ink 68. The time interval of the normal circulation processing (step S8) is not limited to six hours. The circulation time period of the sub tank-side circulation processing (step S83) is not limited to three minutes.

Furthermore, in the determination processing at step S9, when a predetermined time period has elapsed from the printing or a prescribed time is reached, the CPU 70 may determine that the printing operation is to be ended (yes at step S9). The circulation time period of the sub tank-side circulation processing (step S123) of the post-unused-period processing (step S12) is not limited to ten minutes. The circulation time period may be appropriately set depending on the remaining amount of the ink 68 in the sub tank 8 and the liquid feeding ability of the pump 752, respectively.

Furthermore, instead of providing the pump 752 in the tank-side circulation flow path 82, an electromagnetic valve may be provided in the first bypass flow path 85 and the pump 752 may be provided in the tank-side circulation flow path 81. In this case, in the first sub tank discharge processing (step S35), the CPU 70 closes the electromagnetic valve of the first bypass flow path 85 and the electromagnetic valves 761 and 762, and opens the electromagnetic valves 763 and 764. Then, the CPU 70 may drive the pump 752 of the tank-side circulation flow path 81 and may return the ink 68 from the sub tank 8 to the main tank 30. The number of the heads of the head portion 67 is not limited to four. Further, the sub tank 8 need not necessarily be provided.

Furthermore, the agitation processing (step S16) need not necessarily be performed before the main tank-side circulation processing (step S17). Further, the agitation processing (step S31) need not necessarily be performed before the main tank-side circulation processing (step S32). In addition, the deaeration portion 60 need not necessarily be provided. Further, the deaeration processing need not necessarily be performed in the main tank-side circulation processing (step S17, step S32). Further, the agitation processing (step S81) need not necessarily be performed before the sub tank-side circulation processing (step S83). The agitation processing (step S121) need not necessarily be performed before the sub tank-side circulation processing (step S122).

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a head configured to eject an ink;

a main tank configured to store the ink;

a sub tank configured to store the ink supplied from the main tank;

a tank-side supply flow path configured to supply the ink from the main tank to the sub tank;

a tank-side circulation flow path configured to circulate the ink from the sub tank to the main tank;

a first bypass flow path configured to connect the tank-side supply flow path and the tank-side circulation flow path;

a head-side supply flow path configured to supply the ink from the sub tank to the head;

a first pump provided in the tank-side supply flow path;

a processor; and a memory storing computer-readable instructions that, when executed by the processor, cause the processor to perform processes including:

driving the first pump and performing printing-time circulation processing that circulates the ink in the main tank, the tank-side supply flow path, the first bypass flow path and the tank-side circulation flow path, while the head is ejecting the ink to print an image on a recording medium.

2. The printer according to claim 1, further comprising:
a deaeration portion provided in the tank-side supply flow path and configured to remove air from the ink,
wherein
the processor drives the deaeration portion and performs the printing-time circulation processing.

3. The printer according to claim 1, wherein
before the printing-time circulation processing, the processor drives the first pump and performs pre-filling circulation processing that circulates the ink in the main tank, the tank-side supply flow path, the first bypass flow path and the tank-side circulation flow path, and
after the pre-filling circulation processing, the processor drives the first pump and performs sub tank filling processing that supplies the ink from the main tank to the sub tank via the tank-side supply flow path.

4. The printer according to claim 3, wherein
before the sub tank filling processing, the processor performs first sub tank discharge processing that returns the ink from the sub tank to the main tank via the tank-side circulation flow path.

5. The printer according to claim 3, further comprising:
an agitation blade provided inside the main tank and configured to agitate the ink in the main tank; and
a motor configured to drive the agitation blade,
wherein
before the pre-filling circulation processing, the processor drives the motor and performs agitation processing of the ink in the main tank.

6. The printer according to claim 1, wherein
the processor performs unused state determination processing that determines whether a time period during which the ink is not ejected from the head exceeds a predetermined time period, and
when the processor determines, in the unused state determination processing, that the time period during which the ink is not ejected from the head exceeds the predetermined time period, the processor performs second sub tank discharge processing that returns the ink from the sub tank to the main tank via the tank-side circulation flow path.

7. The printer according to claim 1, further comprising:
a second pump provided in the tank-side circulation flow path;
a head-side circulation flow path configured to return the ink from the head;
a second bypass flow path configured to connect the head-side supply flow path and the head-side circulation flow path; and
a third pump provided in the second bypass flow path,
wherein
the processor drives the second pump at a predetermined time interval and performs sub tank-side circulation processing that circulates the ink in the sub tank, the tank-side circulation flow path, the first bypass flow path and the tank-side supply flow path, and
at a time of the sub-tank side circulation processing, the processor drives the third pump and performs head-side circulation processing that circulates the ink in the head-side supply flow path, the head, the head-side circulation flow path and the second bypass flow path.

8. The printer according to claim 1, further comprising:
an agitation blade provided inside the main tank and configured to agitate the ink in the main tank; and
a motor configured to drive the agitation blade,
wherein
before the printing-time circulation processing, the processor drives the motor and performs agitation processing of the ink in the main tank.

9. A control method of a printer,
the printer including:
a head configured to eject an ink;
a main tank configured to store the ink;
a sub tank configured to store the ink supplied from the main tank;
a tank-side supply flow path configured to supply the ink from the main tank to the sub tank;
a tank-side circulation flow path configured to circulate the ink from the sub tank to the main tank;
a first bypass flow path configured to connect the tank-side supply flow path and the tank-side circulation flow path;
a head-side supply flow path configured to supply the ink from the sub tank to the head;
a first pump provided in the tank-side supply flow path; and
a processor,
the control method of the printer comprising a step of:
driving the first pump and performing printing-time circulation processing that circulates the ink in the main tank, the tank-side supply flow path, the first bypass flow path and the tank-side circulation flow path, while the head is ejecting the ink to print an image on a recording medium.

10. A non-transitory computer-readable medium storing computer-readable instructions that, when executed by a processor of a printer including:
a head configured to eject an ink;
a main tank configured to store the ink;
a sub tank configured to store the ink supplied from the main tank;
a tank-side supply flow path configured to supply the ink from the main tank to the sub tank;
a tank-side circulation flow path configured to circulate the ink from the sub tank to the main tank;
a first bypass flow path configured to connect the tank-side supply flow path and the tank-side circulation flow path;
a head-side supply flow path configured to supply the ink from the sub tank to the head;
a first pump provided in the tank-side supply flow path; and
a processor,
perform processes comprising:
driving the first pump and performing printing-time circulation processing that circulates the ink in the main tank, the tank-side supply flow path, the first bypass flow path and the tank-side circulation flow path, while the head is ejecting the ink to print an image on a recording medium.

* * * * *